US007558502B2

(12) United States Patent
Kanai

(10) Patent No.: US 7,558,502 B2
(45) Date of Patent: Jul. 7, 2009

(54) IMAGE FORMING APPARATUS

(75) Inventor: Dai Kanai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 220 days.

(21) Appl. No.: 11/754,807

(22) Filed: May 29, 2007

(65) Prior Publication Data

US 2007/0280721 A1 Dec. 6, 2007

(30) Foreign Application Priority Data

May 30, 2006 (JP) ..... 2006-149453

(51) Int. Cl.
*G03G 21/20* (2006.01)

(52) U.S. Cl. ..... 399/92

(58) Field of Classification Search ..... 399/91, 399/92, 93, 94, 97, 122, 320, 322, 401
See application file for complete search history.

(56) References Cited

U.S. PATENT DOCUMENTS 6,026,275 A * 2/2000 Matsuzoe et al. ..... 399/335
6,741,815 B1 * 5/2004 Fujita et al. ..... 399/45
7,082,272 B2 * 7/2006 Takano ..... 399/69
7,383,016 B2 * 6/2008 Lee et al. ..... 399/400

FOREIGN PATENT DOCUMENTS

| | | |
|---|---|---|
| JP | 04-051179 | 2/1992 |
| JP | 2002-082591 | 3/2002 |
| JP | 2004-109732 | 4/2004 |

* cited by examiner

*Primary Examiner*—Hoan H Tran
(74) *Attorney, Agent, or Firm*—Canon USA Inc IP Div

(57) ABSTRACT

An image forming apparatus includes a fixing member for fixing toner images on a sheet by heat, a first blowing device for blowing air for cooling the fixing member, and a second blowing device for blowing air for cooling the sheet on which toner images are fixed by the fixing member at the downstream side in conveying direction from the fixing member. The second blowing device blows air at a flow rate related to a flow rate at which the first blowing device blows air.

9 Claims, 4 Drawing Sheets

IMAGE FORMING APPARATUS

BACKGROUND OF THE INVENTION

1. Field of the Invention

The present invention relates to an image forming apparatus for forming an image on a sheet.

2. Description of the Related Art

Recently, smaller size and higher speed have been demanded in an image forming apparatus. Such image forming apparatus is often accompanied by technical problems. That is, for example, heat is transferred to a recording material in the fixing means, so that the conveyed recording material becomes a heat source and the temperature of the entire apparatus is raised.

As a second problem, in the recording material receiving heat, when sheets are discharged and stacked continuously, sheets are adhered to each other between the face and back side of the recording material. Sticking of sheets is likely to occur on OHT (Over Head Transparency) sheets or thick paper when the heating performance is improved in the fixing device or when sheets of thin paper printed on both sides are stacked up continuously, with an attempt to improve the fixing performance of images.

An important object is how to cool the recording material effectively after fixing.

It has been generally proposed to install a cooling fan for blowing air in the conveying path after fixing and cool off the heat applied to the recording material. Japanese Patent Application Laid-Open (JP-A) No. 2002-082591 discloses an image forming apparatus including size detecting means which detects the size of recording material, and an air duct for blowing fresh air into the recording material after fixing by blowing means. In this image forming apparatus, the wind width of the fresh air blown to the recording material is adjusted in a direction orthogonal to the conveying direction of the recording material based on the detection signal by the size detecting means.

Japanese Patent Application Laid-Open No. 2004-109732 proposes to realize a further cooling effect of the recording material by disposing a cooling roller at the downstream side of the conveying direction from the fixing device, and cooling the cooling roller by blowing air to the cooling roller with a cooling fan. A higher speed has been demanded not only in recording material with maximum width, but also in recording material with small width.

When recording materials with smaller width than the maximum width are fixed continuously by the fixing device, the temperature of non-passing region not contacting with the recording materials in the heating roller of the fixing device is raised excessively. When recording materials of small width pass the fixing device continuously, heat is locally accumulated in the non-passing region not contacting with the recording materials by the portion not deprived of heat by the passing recording materials. This phenomenon is called temperature rise in non-passing region or temperature rise in end region of the fixing device. When the non-passing portion of the fixing device is raised in temperature, the components of the fixing device and the pressure roller opposite to the heating roller exceed the temperature rise limits, and these components are lowered in precision. This phenomenon of temperature rise in non-passing portion or temperature rise in end portion is particularly obvious in the heating roller of thin wall and small heat capacity.

To prevent temperature rise in non-passing portion, a structure of installing a blowing fan for blowing air to the non-passing portion of the roller pair of the fixing device and suppressing temperature rise in the non-passing portion is proposed in Japanese Patent Application Laid-Open No. 04-051179.

It may be considered to provide the fixing device with both a cooling fan for cooling the recording materials and a fan for non-passing portion for cooling the non-passing portion of the heating roller. In this structure, the air from the cooling fan for cooling the recording materials and the air from the non-passing portion fan for cooling the heating roller are converged and exhausted out of the device, but if the flow rate is excessive, exhaust may not be sufficient. The portion of air not exhausted out of the device returns to the conveying path before fixing by way of the outer circumference of the fixing device.

The air after cooling of recording materials or the air after cooling of non-passing portion of the heating roller is high in temperature. When such air returns to the conveying path before fixing, temperature rises in the transfer means for transferring unfixed image on the recording material or the image forming portion, and it has adverse effects on the image forming portion. For example, the toner may be melted in the image forming portion due to the temperature rise in the image forming portion. Further, as the device is reduced in size and the conveying speed of recording materials is increased, the flow rate of the cooling fan must be increased, and it is feared that adverse effects may be increased on the image forming portion due to return of air into the conveying path before fixing. If the air stream returning to the upstream side of the fixing device is not caused by the air after cooling the non-passing portion of the heating roller or recording materials, when the air after cooling the non-passing portion of the heating roller or recording materials remains in the device, a temperature rise in the device occurs, and other problems may be induced.

SUMMARY OF THE INVENTION

The present invention is directed to an image forming apparatus that can correct failure in sufficient exhaust of air blown from the blowing device.

According to an aspect of the present invention, an image forming includes a fixing member configured to fix a toner image on a sheet by heat, a first blowing device configured to blow air for cooling the fixing member, and a second blowing device configured to blow air for cooling the sheet on which a toner image was fixed by the fixing member. The second blowing device blows air at a flow rate related to a flow rate at which the first blowing device blows air.

According to another aspect of the present invention, an image apparatus includes a first blowing device configured to blow air, a second blowing device configured to blow air, and an exhausts port exhausting air flows blown from the first blowing device and the second blowing device to the outside of the apparatus. The first blowing device and the second blowing device do not blow air at each maximum flow rate at the same time.

Further features of the present invention will become apparent from the following description of exemplary embodiments with reference to the attached drawings.

DESCRIPTION OF THE EMBODIMENTS

Figure 1:
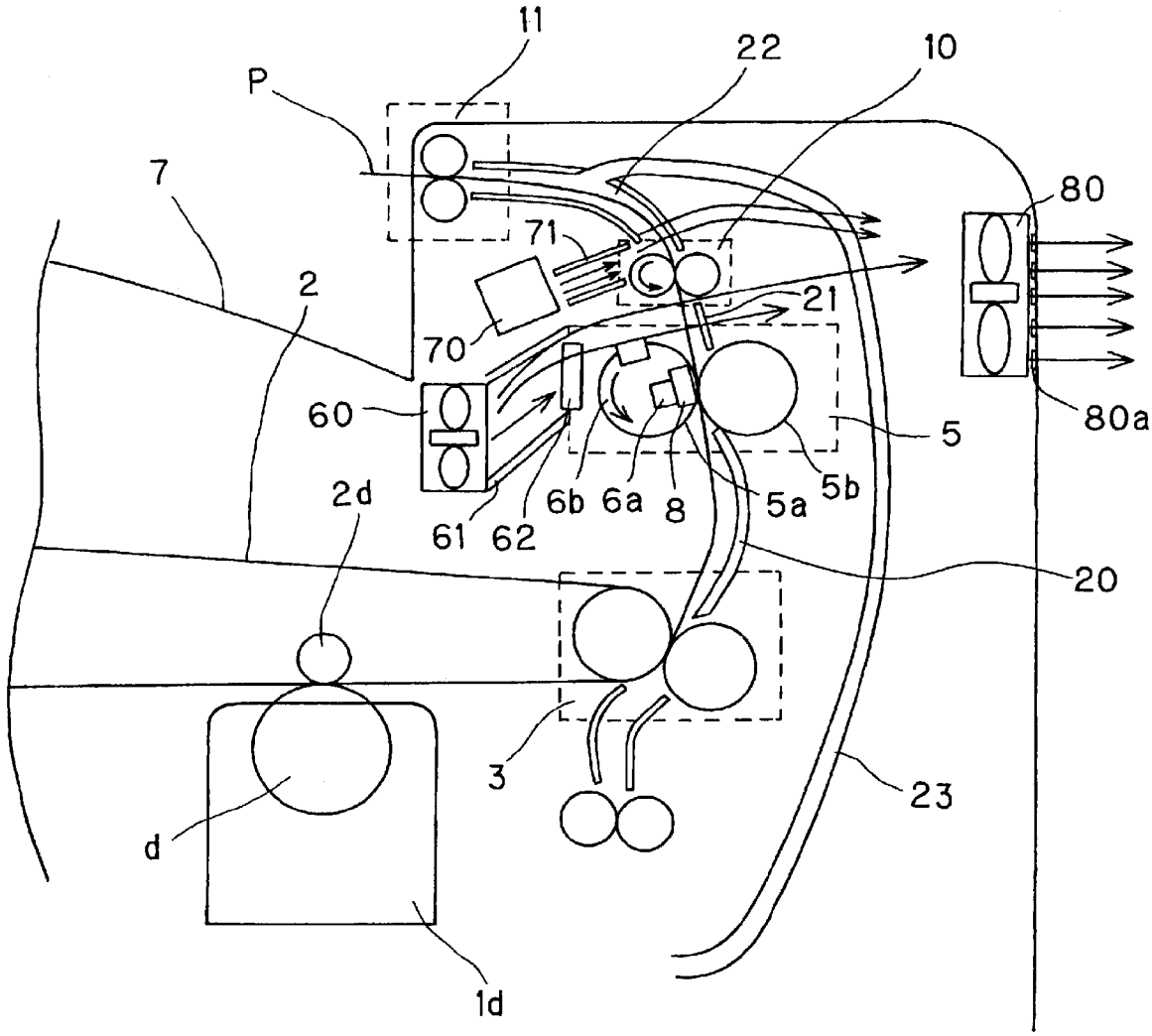
FIG. 1 is a sectional view of image forming apparatus in an embodiment of the invention.

An embodiment of the invention is described below with reference to the accompanying drawings. Throughout the drawings showing the embodiment, same parts or corresponding parts are identified with the same reference numerals. Dimensions, materials, shapes, and relative configuration of components of the embodiment are not intended to limit the scope of the invention unless otherwise specified. In the embodiment, the "air flow rate" is for example changeable by changing the rotating speed of the fan based on the pressure-air flow rate characteristic diagram of each fan or changing the size of the outlet of the duct through which the air from the fan passes by changing the position of the shutter installed at the outlet of the duct.

Figure 2:
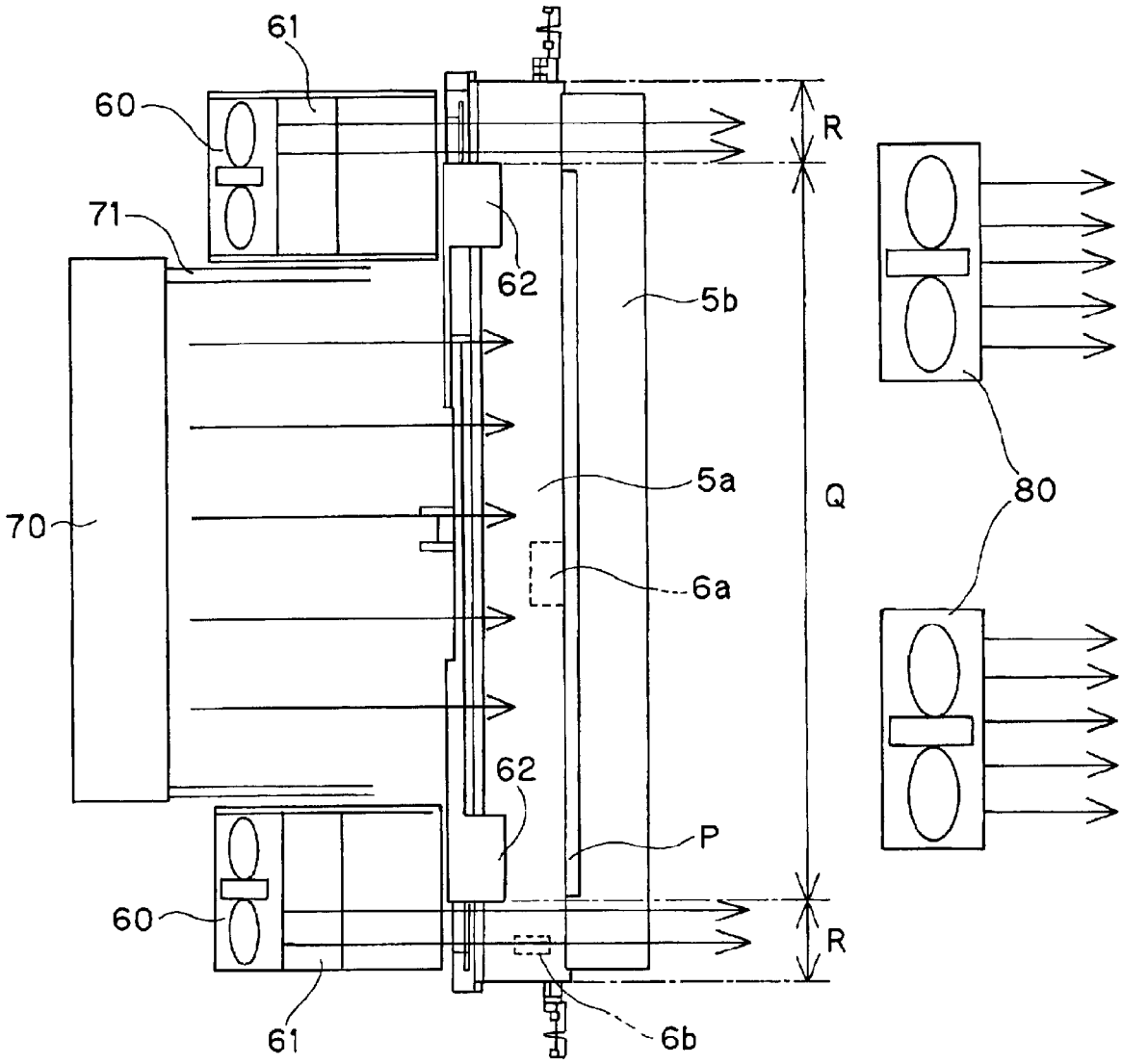
FIG. 2 is a top view of image forming apparatus in an embodiment of the invention.
Figure 3:
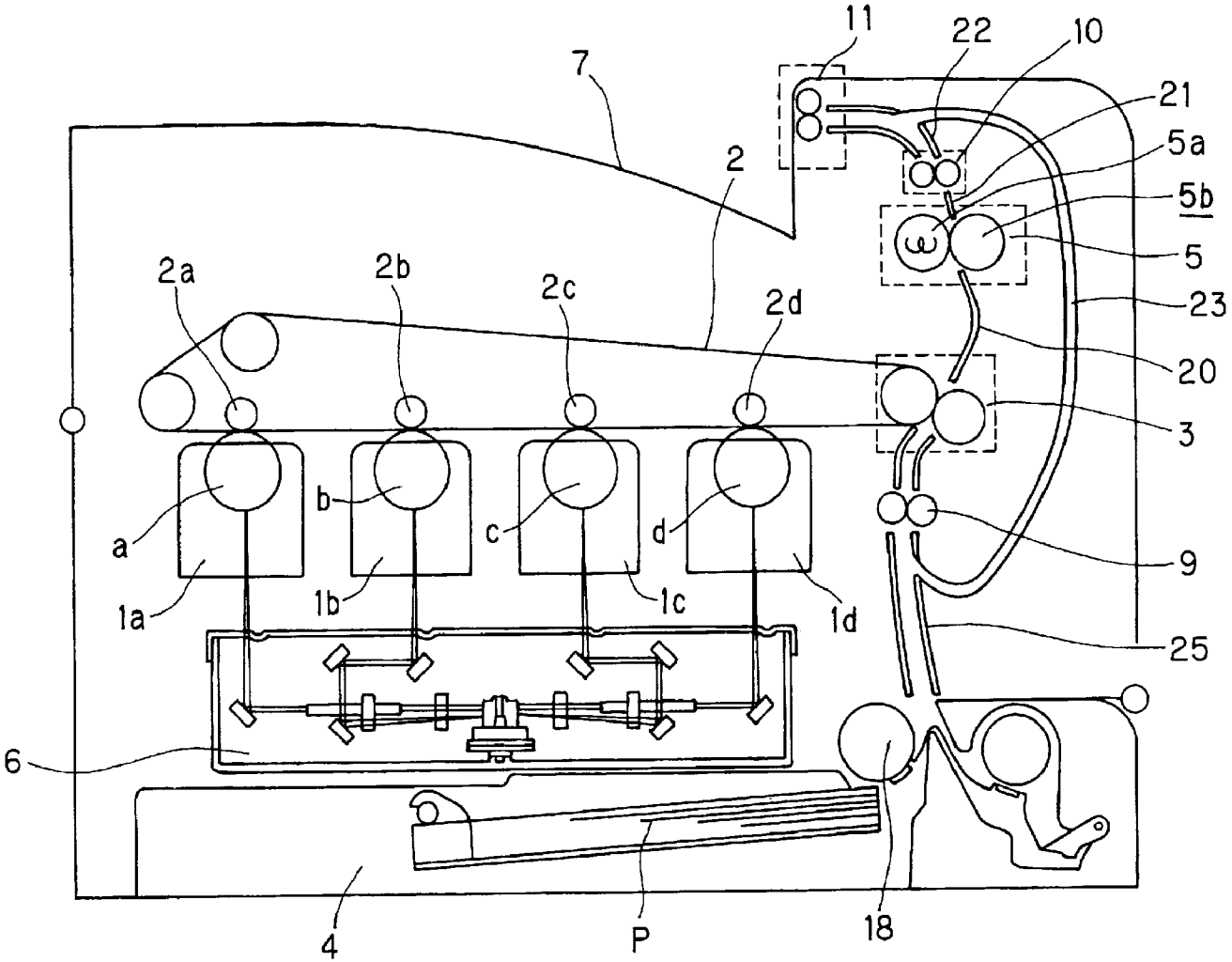
FIG. 3 is a sectional view of image forming apparatus.

FIG. 1 shows an outline of a configuration of an image forming apparatus of the invention. FIG. 2 shows a configuration of an image forming apparatus in an embodiment of the invention. FIG. 3 is a sectional view of an image forming apparatus.

Based on FIG. 3, the configuration of an image forming apparatus will be explained. The image forming apparatus forms toner images in yellow, magenta, cyan, and black colors. It has four photosensitive drums a (yellow), b (magenta), c (cyan), and d (black) disposed in parallel as image forming media. Above the photosensitive drums a to d, an intermediate transfer belt 2 is provided as a transfer and conveying unit disposed to cross vertically.

The photosensitive drums a, b, c, d driven by motor (not shown) are surrounded with primary charger, development portion, and transfer charger (not shown), and the photosensitive drums are assembled in portion as process cartridges 1*a* to 1*d*.

Underneath the photosensitive drums a to d, an exposure device 6 composed of rotary polygon mirrors is disposed. On the photosensitive drum a, laser light corresponding to an image signal of the yellow color component of the original is projected through the rotary polygon mirror of the exposure device 6, and an electrostatic latent image is formed on the photosensitive drum a. A yellow toner is supplied from the development portion to develop the electrostatic latent image in order to visualize as a yellow toner image.

As the photosensitive drum a rotates, the toner image comes to a primary transfer position where the photosensitive drum a contacts with the intermediate transfer belt 2, and the yellow toner image on the photosensitive drum a is transferred on the intermediate transfer belt 2 by a primary transfer bias applied to a transfer charging member 2*a* (primary transfer).

Consequently, when the position of the intermediate transfer belt 2 carrying the yellow toner image is moved to the image forming portion, a magenta toner image is formed on the photosensitive drum b in the image forming portion, up to this moment in the same manner as above. This magenta toner image is transferred on the intermediate transfer belt 2 from above the yellow toner image.

Similarly, as the intermediate transfer belt 2 moves, the cyan toner image and the black toner image are overlaid and transferred on the yellow toner image and the magenta toner image at each primary transfer position of the image forming portion.

Sheets or recording materials P are contained in a cassette 4. The recording materials P are sent out one by one from the cassette 4 by a pickup roller 18 and guided into a registration roller 9 by a sheet guide 25. The recording material can be timed by the registration roller 9. Reaching a secondary transfer position, four color toner images on the intermediate transfer belt 2 are transferred in batch on the recording material P by a secondary transfer bias applied to a secondary transfer roller pair 3 (secondary transfer). Thus, the image forming portion for forming images on the recording material is configured by the photosensitive drums a to d, the exposure device 6, the intermediate transfer belt 2, and the secondary transfer roller pair 3.

The recording material P on which the four color toner images are transferred is guided by a post-transfer conveying guide 20 provided at the downstream side of the secondary transfer roller pair 3, and is conveyed to a fixing roller pair 5 composed of heating a roller 5*a* and a pressure roller 5*b*. In this fixing roller pair 5, heat and pressure are applied, and toner images are fixed. As a result, color toners are melted and mixed, and fixed on the recording material P.

After the toner images are fixed on the recording material P, the recording material is conveyed by the fixing roller pair 5 and guided by a post-fixing conveying guide 21. The recording material is conveyed by a cooling roller 10 as a cooling and conveying unit provided at the downstream of the fixing roller pair 5. In succession, the recording material conveyed by the cooling roller 10 is guided by a conveying guide 22 into discharge roller pair 11. The recording material is discharged on a tray 7 by the discharge roller pair 11.

When the image is formed on both sides of the recording material, the recording material is led to a both-sides transporting path 23 by the discharge roller pair 11. The recording material is guided to the registration roller 9 by the both-sides transporting path 23 (Refer to FIG. 3). Thereafter, the toner image on the intermediate transfer belt 2 is transferred on the recording material, and the toner image is fixed on the record material by fixing roller pair 5. The recording material conveyed by the cooling roller 10 which is disposed on the downstream side of the fixing roller pair 5 is guided by a conveying guide 22 into discharge roller pair 11. The discharge roller pair 11 discharges the recording material on which the image is formed on both sides on the tray 7.

As explained herein, the recording material is conveyed in the conveying path formed by the sheet guide 25, the post-transfer conveying guide 20, the post-fixing conveying guide 21, and the conveying guide 22. Images are formed on the recording material by the image forming portion, and the toner images are fixed on the recording material by the fixing roller pair 5.

Along the nearly vertical direction of the conveying direction of the recording material P, a non-passing portion cooling duct 61 is disposed as shown in FIG. 1. A non-passing portion cooling fan 60 is disposed inside the non-passing portion cooling duct 61.

The non-passing portion cooling duct 61 is a duct for passing air for cooling the non-passing region R of the fixing region not contacting with the recording materials of small size when the recording materials of smaller size in the width direction than the maximum size capable of forming images by the image forming apparatus pass through the fixing region Q continuously. The non-passing portion cooling duct 61 is provided at a position in an outside region (non-passing region) in an axial direction (width direction of recording material) of the fixing roller pair 5 than the passing region of the recording materials of smaller size.

That is, the non-passing portion cooling duct 61 blows air to the non-passing region of the heating roller 5*a*, and the cooling air blown from the non-passing portion cooling duct 61 passes the conveying path at the downstream side of the recording material conveying path of the heating roller 5*a*. The cooling air passing the conveying path is exhausted to the outside through an exhaust port 80*a* formed on the outside of the apparatus by an exhaust fan 80. That is, the air from the non-passing portion cooling duct 61 and passing through the heating roller 5*a* flows to cross the conveying path at the downstream side of the fixing roller pair 5.

A shutter 62 is provided at the outlet of the non-passing portion cooling duct 61 at the heating roller 5*a* side, and the blowing region from the non-passing portion cooling fan 60 can be changed to an optimum width depending on the size of the smaller recording materials passing the heating roller 5*a*.

That is, the shutter 62 operates as a wind direction changing unit depending on the size of recording material so that the air from the non-passing portion cooling fan 60 may be directed toward the non-passing region of the heating roller 5*a*. A first blowing device is constructed by the non-passing portion cooling fan 60, the non-passing portion cooling duct 61, and the shutter 62.

Further, two thermistors are provided, that is, a main thermistor 6*a* as a first temperature detecting unit and a sub-thermistor 6*b* as a second temperature detecting unit. The main thermistor 6*a* is disposed near the center in the longitudinal direction of the heating roller 5*a*. The sub-thermistor 6*b* is provided near the end portion of the heating roller 5*a*.

The main thermistor 6*a* and the sub-thermistor 6*b* have their outputs connected to a control circuit portion 300 (CPU) through an A/D converter. This control circuit portion 300 determines the schedule of temperature control of the fixing heater 8 based on the outputs from the main thermistor 6*a* and the sub-thermistor 6*b*. By this control circuit portion 300, power supply to the fixing heater 8 is controlled by a heater drive circuit portion as a power supply portion to the heating unit.

At the downstream side of the fixing roller pair 5 of the image forming apparatus and in a direction approximately horizontal to the cooling roller 10, a recording material cooling fan 70 is provided as a second blowing device. A recording material cooling duct 71 is provided as a guiding unit for forming a passage of air generated by the recording material cooling fan 70. As shown in FIG. 1, cooling air is blown to the downstream portion of the cooling roller 10 and is exhausted outside from the exhaust fan 80 after cooling the recording materials P and the cooling roller 10.

(Operation of Cooling Fans)

Operation of the non-passing portion cooling fan 60 and the recording material cooling fan 70 at the time of forming images on the recording material P is described below.

Figure 4:
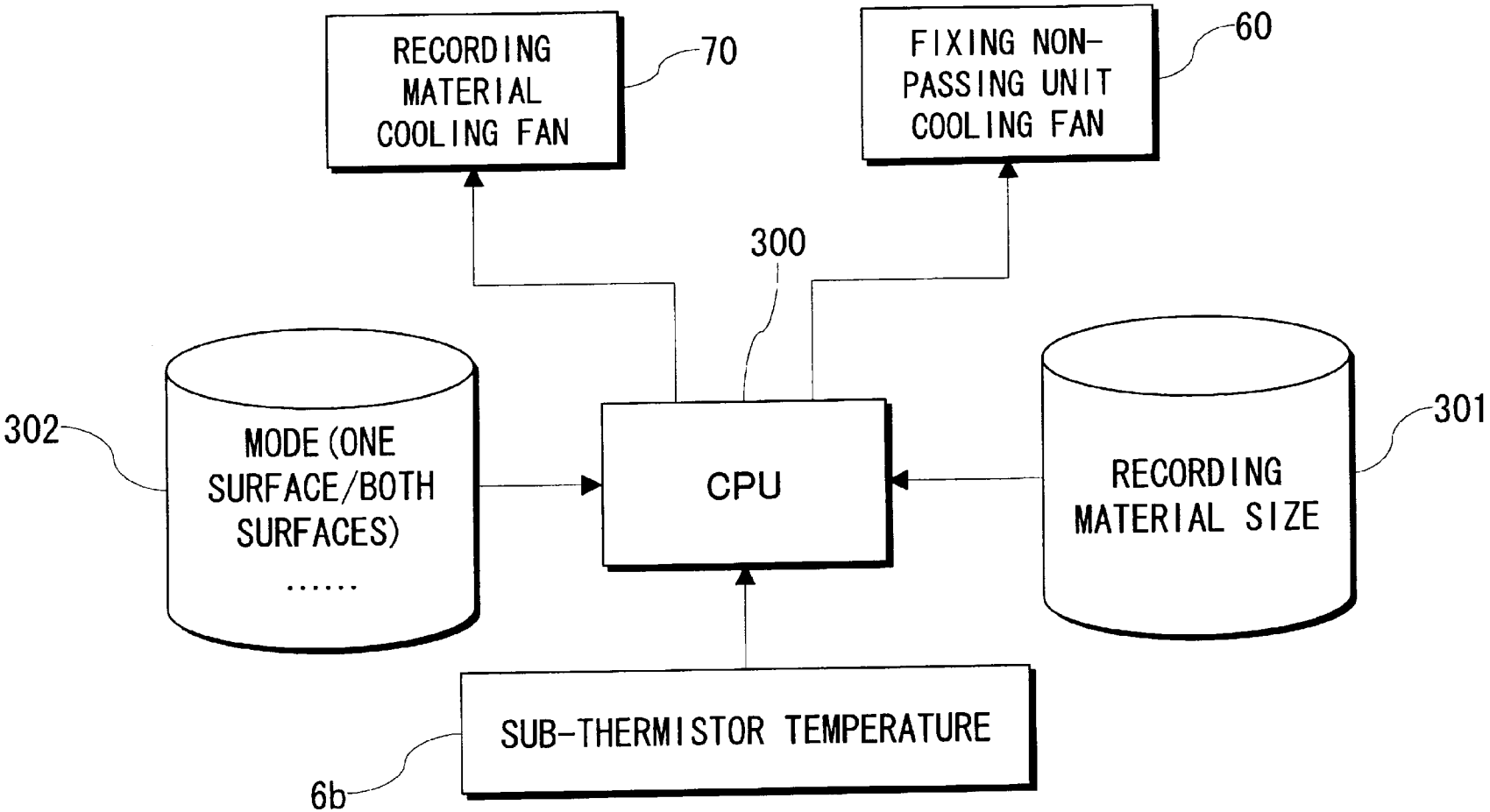
FIG. 4 is a block diagram showing control of both cooling fans in an embodiment of the invention.

FIG. 4 is a block diagram of the operation control of both cooling fans in an image forming process. Information on a size of the recording material 301 and an image formation mode 302 (one side/both sides) is input to control circuit portion 300.

First, when recording materials smaller than the width of the heating roller 5*a* are fixed continuously in an image forming process, the temperature of the non-passing region R elevates. At this time, the internal temperature of the heating roller 5*a* is detected by the sub-thermistor 6*b*. When the thermistor 6*b* detects a specified temperature, the control circuit portion 300 controls a start operation of the non-passing region cooling fan 60, and the temperature rise of non-passing region is suppressed. By the air stream from the fixing non-passing portion cooling fan 60, heated parts including the non-passing region are cooled, and when the temperature declines below a specified temperature detected by the sub-thermistor 6*b*, the control circuit portion 300 controls a stop operation of the non-passing portion cooling fan 60.

The on/off temperature range of the non-passing portion cooling fan 60 by the temperature detected by the sub-thermistor 6*b* is varied depending on the size and thickness of the recording material or the operating environment, as controlled by the control circuit portion 300. Operation of the non-passing portion cooling fan 60 is set as shown in Table 1 according to the size of the recording material in the width direction. Depending on the size of the recording material in the width direction, the operation of the shutter 62 is also controlled by the control circuit portion 300.

Operation of the recording material cooling fan 70 in an image forming process is changed in rotating speed depending on the size and thickness of recording material P and in an image forming mode of one-surface or both surfaces printing, and the air flow rate of the recording material cooling fan 70 is controlled by the control circuit portion 300. Table 1 shows the data for explaining the operation of the recording material cooling fan 70 and the non-passing portion cooling fan 60.

TABLE 1

| | | RECORDING MATERIAL COOLING FAN | | NON-PASSING PORTION COOLING |
|---|---|---|---|---|
| RECORDING MATERIAL | WIDTH [mm] | ONE SURFACE | BOTH SURFACE | FAN ON/OFF |
| A3 | 297 | ¼ SPEED | FULL SPEED | OFF |
| B4 | 257 | OFF | HALF SPEED | ON |
| A4 | 297 | ¼ SPEED | FULL SPEED | OFF |
| B5 | 257 | OFF | HALF SPEED | ON |
| LDR | 279.4 | ¼ SPEED | FULL SPEED | ON |
| LGL | 215.9 | OFF | HALF SPEED | ON |
| LTR | 279.4 | ¼ SPEED | FULL SPEED | ON |
| A4R | 210 | OFF | HALF SPEED | ON |
| LTRR | 215.9 | OFF | HALF SPEED | ON |
| STMTR | 215.9 | OFF | HALF SPEED | ON |
| EXE | 266.7 | OFF | HALF SPEED | ON |
| 12" × 18" | 304.8 | ¼ SPEED | FULL SPEED | OFF |
| SRA3 | 320 | OFF | FULL SPEED | OFF |
| K8 | 270 | OFF | HALF SPEED | ON |
| K16 | 270 | OFF | HALF SPEED | ON |

In this embodiment, the operation of the recording material cooling fan 70 is changed as shown in Table 1. When heated recording materials are continuously discharged to the tray 7 and stacked up on the tray 7, sheets are likely to adhere between the face and back side of the recording materials. This phenomenon is particularly obvious when toner fixed sides are face to face in both surfaces printing. When forming an image on one surface of the recording material P, the recording material cooling fan 70 is turned off or operated at low speed, and when forming an image on both sides, the fan is operated at half speed or full speed. Operation of the non-passing portion cooling fan 60 is set as shown in Table 1 based on the size of recording material in the width direction.

In the embodiment, the fan is operated at a low rotating speed in one surface printing in the case of A4 format paper lateral feed of high feed speed of recording materials P and short discharging interval, or in the case of A3 format paper not moving the non-passing portion cooling fan 60 in an image forming process. In both surfaces printing, the fan is operated at full speed.

In the case of lateral feed of LTR paper fast in production speed and operating the non-passing portion cooling fan 60, the overheating portion of the heating roller 5*a* in the non-passing region is narrow, and the air flow rate from the non-passing portion cooling duct 61 is small. Hence, the recording material cooling fan 70 is operated the same as in the case of A4 format paper. At this time, the total of the air flow rate from the non-passing portion cooling duct 61 and the air flow rate from the recording material cooling duct 71 is smaller than the total of the air flow rate from the exhaust fan 80 for exhausting the air flows from both ducts.

That is, the flow rate of the air from the non-passing portion cooling duct 61 is more when the sheet size in the width direction is smaller. When the sheet size in the width direction is small and the flow rate of the air blown from the non-passing portion cooling duct 61 is large, the flow rate of the air blown from the recording material cooling duct 71 is regulated. In the embodiment, when the sheet size in the width direction is the minimum size and the flow rate of the air blown from the non-passing portion cooling duct 61 is the maximum, the control circuit portion 300 controls the rotating speed of the recording material cooling fan 70 to half speed. By such control, it is effective to avoid adverse effects on the image forming portion due to flow of the air blown from the non-passing portion cooling duct 61 and the recording material cooling duct 71 into the image forming portion at the upstream side of the fixing roller pair 5 not completely exhausted out of the device from the exhaust port 80*a*.

To the contrary, in the case of A4 format paper vertical feed, when the discharging interval is half of A4 format lateral feed, and in the case of recording material P wide in cooling region of heating roller by the non-passing portion cooling fan 60, the recording material cooling fan 70 is turned off when forming an image on one surface and is operated at half speed when forming images on both sides. At this time, since the discharging and stacking interval of recording materials P is half of A4 format lateral feed, the recording materials are cooled naturally on the discharge tray 7. Hence, if the flow rate of cooling air from the recording material cooling duct 71 is small, sticking of recording materials can be prevented. The flow rate of cooling air from the non-passing portion cooling duct 61 is large since the non-passing region of the heating roller 5*a* is wide, but the flow rate of cooling air from the recording material cooling duct 71 is small, the total of flow rates from two ducts is smaller than the total of flow rate of the exhaust fan 80.

As far as the total of flow rate of the exhaust fan 80 exhausting the cooling air flows is larger than the total of the flow rate of cooling air flows from the non-passing portion cooling duct 61 and the recording material cooling duct 71, the rotating speed of the recording material cooling fan 70 is not required to be the same as in the embodiment.

For example, the values are not limited to those given in the embodiment. That is, when stopping the non-passing portion fan 60 by passing recording materials longer in length in the width direction, it is controlled to increase the air flow rate from the recording material cooling fan 70, than in the case of operation of the non-passing portion fan 60 by passing recording materials shorter in length in the width direction.

Among recording materials of small size, in the case of a slightly large size, and when the blowing region is smaller in the fixing roller pair 5 of the air flow blown by the non-passing portion fan 60, the air flow from the recording material cooling fan 70 is increased than in the case of smaller size and larger blowing region on the fixing roller pair 5. That is, the cooling state of the fixing roller by the non-passing portion fan 60 is changed depending on the sheet size in the width direction crossing with the conveying direction by changing the rotating speed of the non-passing portion fan 60, or operating the shutter 62. Depending on the cooling state of the non-passing portion fan 60, the air flow rate of the recording material cooling fan 70 is changed. In the case of recording materials more in the number of passing per unit time, it is controlled to increase the air flow rate of the recording material cooling fan 70 than in the case of recording materials smaller in the number of passing per unit time. In this case, the small flow rate of air from the recording material cooling fan 70 includes a state of stop of operation of the recording material cooling fan 70.

As mentioned above, by controlling the operation of the non-passing portion fan 60 and the recording material cooling fan 70, overheating is suppressed in the non-passing portion of the fixing unit when conveying recording materials of small size, and the productivity can be enhanced. At the same time, if the conveying path from the fixing portion to the discharge portion is shortened as a result of reduction of size of the image forming apparatus, the temperature of the recording materials P can be lowered, and sticking of sheets can be effectively prevented.

In the embodiment, as described above, the operation of the recording material cooling fan 70 is controlled based on the operation setting of the non-passing portion fan 60. Therefore, if the air flows blown from the non-passing portion fan 60 and the recording material cooling fan 70 are not fully exhausted by the exhaust fan 80, the internal air is prevented from returning to the conveying path at the upstream side from the fixing roller pair 5 by way of the outer circumference of the heating roller 5*a* and pressure roller 5*b*. However, increasing of rotating speed of the exhaust fan 80 to increase the exhaust capacity is not preferred because the noise of the image forming apparatus is increased.

If recording materials P once fixed in both surfaces image forming are conveyed again to the image forming portion, a temperature rise of the image forming portion due to the temperature of the recording materials P can be suppressed.

In the image forming process, the temperature rise of the image forming portion due to return of hot air from the fixing unit can be suppressed by setting the total of air flow of the exhaust fan 80 more than the total of air flow from the non-passing portion cooling duct 61 and the air flow from the recording material cooling duct 71. By exhausting the air flows from the non-passing portion cooling fan 60 and the recording material cooling fan 70 from the same exhaust port, the exhaust fans 80 are not required individually, and the noise can be lowered and the cost can be saved. Since the region occupied by the exhaust port can be narrowed, an effective space for operational use can be increased in the region not exposed to the exhaust of hot air.

The invention is specifically described above by referring to the embodiment, but the invention is not limited to the embodiment alone, but may be changed and modified in various forms based on the technical concept of the invention. For example, the numerical values mentioned in the embodiments are mere examples, and other different numerical values may be applied as required.

This application claims the benefit of Japanese Patent Application No. 2006-149453, filed May 30, 2007, which is hereby incorporated by reference herein in its entirety.

What is claimed is:

1. An image forming apparatus comprising:

a fixing member configured to fix a toner image on a sheet by heat;

a first blowing device configured to blow air for cooling the fixing member; and a second blowing device configured to blow air for cooling the sheet on which the toner image was fixed by the fixing member, wherein the second blowing device blows air at a flow rate related to a flow rate at which the first blowing device blows air.

2. An image forming apparatus according to claim 1, wherein the second blowing device blows air at an increased air flow rate when the first blowing device is set not to operate as compared to when the first blowing device is set to operate.

3. An image forming apparatus according to claim 2, wherein the first blowing device blows air to the fixing member so as to cool a non-passing region not contacting with the sheet passing in the fixing member, and wherein the first blowing device is changed in operation depending on the size of the sheet in width direction crossing with the sheet conveying direction.

4. An image forming apparatus according to claim 1, wherein the first blowing device blows air for cooling a non-passing region not contacting with the sheet passing in the fixing member, wherein the first blowing device is changed in operation depending on the size of the sheet in width direction so that the blown air is directed toward the non-passing region, and wherein the second blowing device blows air at an increased flow rate, when the region of the fixing member cooled by the first blowing device is smaller in the case of the first size of the sheet in the width direction, as compared to when the sheet size in the width direction is second size smaller than the first size and the region of the fixing member to be cooled by the first blowing device is larger.

5. An image forming apparatus according to claim 1, wherein the air blown from the first blowing device flows into a conveying path disposed on a downstream of the fixing member in a sheet conveying direction after passing the fixing member.

6. An image forming apparatus according to claim 1, further comprising an exhaust port exhausting the air flow blown from the first blowing device and the second blowing device to the outside of the apparatus.

7. An image forming apparatus according to claim 1, further comprising an exhaust device exhausting the air flow blown from the first blowing device and the second blowing device to the outside of the apparatus, wherein the operation of the first blowing device and the second blowing device is controlled so that the total of air flow blown from the first blowing device and air flow blown from the second blowing device is smaller than the flow rate of the air exhausted by the exhaust device.

8. An image forming apparatus according to claim 1, wherein the first blowing device is set in operation based on the sheet size in the width direction crossing with the sheet conveying direction.

9. An image forming apparatus comprising:

a first blowing device configured to blow air;

a second blowing device configured to blow air; and an exhausts port exhausting air flows blown from the first blowing device and the second blowing device to the outside of the apparatus, wherein the first blowing device and the second blowing device do not blow air at each maximum flow rate at the same time.

* * * * *